US011677161B1

(12) United States Patent
Tabatabai et al.

(10) Patent No.: US 11,677,161 B1
(45) Date of Patent: Jun. 13, 2023

(54) APPARATUS, SYSTEM, AND METHOD FOR TRANSFERRING RADIO FREQUENCY SIGNALS BETWEEN PARALLEL WAVEGUIDES IN ANTENNAS

(71) Applicant: Meta Platforms, Inc., Menlo Park, CA (US)

(72) Inventors: Farbod Tabatabai, San Francisco, CA (US); Qi Tang, Los Angeles, CA (US); Eric Booen, Thousand Oaks, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 131 days.

(21) Appl. No.: 17/388,237

(22) Filed: Jul. 29, 2021

Related U.S. Application Data

(60) Provisional application No. 63/064,615, filed on Aug. 12, 2020.

(51) Int. Cl.
*H01Q 21/06* (2006.01)
*H01Q 13/10* (2006.01)
*H01Q 21/00* (2006.01)

(52) U.S. Cl.
CPC ..... *H01Q 21/065* (2013.01); *H01Q 13/10* (2013.01); *H01Q 21/0031* (2013.01)

(58) Field of Classification Search
CPC ..... H01Q 21/065; H01Q 21/0031; H01Q 21/0037; H01Q 21/0043; H01Q 21/005; H01Q 13/10; H01Q 13/18; H01Q 9/04; H01Q 9/0407; H01Q 9/045; H01Q 19/005
See application file for complete search history.

(56) References Cited

U.S. PATENT DOCUMENTS 6,211,824 B1 * 4/2001 Holden ..... H01Q 9/0414 343/846
2003/0067410 A1 * 4/2003 Puzella ..... H01Q 9/0407 343/700 MS
2015/0222021 A1 * 8/2015 Stevenson ..... H01Q 21/005 343/771

(Continued)

FOREIGN PATENT DOCUMENTS

WO WO-2018095541 A1 * 5/2018

OTHER PUBLICATIONS

Tang et al., "Apparatus, System, and Method for Transferring Radio Frequency Signals Between Waveguides and Radiating Elements in Antennas", U.S. Appl. No. 17/408,195 dated Aug. 20, 2021, 72 pages.

(Continued)

*Primary Examiner* — Jason Crawford
(74) *Attorney, Agent, or Firm* — Greenberg Traurig, LLP

(57) ABSTRACT

A steerable antenna comprising (1) a lower waveguide configured to direct radio frequency signals in a specific direction, (2) an upper waveguide positioned substantially parallel to the lower waveguide, wherein the upper waveguide is configured to direct the radio frequency signals in another direction substantially opposite to the specific direction, and (3) a plate coupled between the lower waveguide and the upper waveguide, wherein the plate includes one or more coupling elements that facilitate transferring the radio frequency signals between the lower waveguide to the upper waveguide. Various other apparatuses, systems, and methods are also disclosed.

20 Claims, 10 Drawing Sheets

(56) References Cited

U.S. PATENT DOCUMENTS

| | | | | |
|---|---|---|---|---|
| 2015/0288063 | A1* | 10/2015 | Johnson | H01Q 3/24 342/368 |
| 2017/0084971 | A1* | 3/2017 | Kildal | H01P 1/207 |
| 2018/0026378 | A1* | 1/2018 | Hadavy | H01Q 21/0087 343/771 |
| 2018/0323490 | A1* | 11/2018 | Harp | H01Q 1/405 |
| 2019/0089065 | A1* | 3/2019 | Sikes | H01Q 21/0031 |
| 2022/0069455 | A1* | 3/2022 | Tang | H01Q 21/0006 |

OTHER PUBLICATIONS

Tabatabai et al., "Apparatus, System, and Method for Preventing Radio Frequency Energy Leaks and Intrusions Via Choke Structures", U.S. Appl. No. 17/393,431 dated Aug. 4, 2021, 59 pages.

Tang, Qi, "Apparatus, System, and Method for Implementing Receive and Transmit Antenna Elements in a Single Aperture", U.S. Appl. No. 17/355,888 dated Jun. 23, 2021, 51 pages.

Tabatabai, Farbod, "Apparatus, System, and Method for Transferring Radio Frequency Signals Between Waveguides and Patch Structures in Antennas", U.S. Appl. No. 17/384,297 dated Jul. 23, 2021, 62 pages.

McGuyer et al., "Apparatus, System, and Method for Beam-Steering via Moiré Patterns", U.S. Appl. No. 17/354,864 dated Jun. 22, 2021, 54 pages.

Tabatabai et al., "Apparatus, System, and Method for Facilitating Satellite Handover via Hybrid Antenna Structures", U.S. Appl. No. 17/354,868 dated Jun. 22, 2021, 54 pages.

* cited by examiner

APPARATUS, SYSTEM, AND METHOD FOR TRANSFERRING RADIO FREQUENCY SIGNALS BETWEEN PARALLEL WAVEGUIDES IN ANTENNAS

INCORPORATION BY REFERENCE

This application claims the benefit of U.S. Provisional Application No. 63/064,615, filed on Aug. 12, 2020, the disclosure of which is incorporated, in its entirety, by this reference.

BRIEF DESCRIPTION OF DRAWINGS

The accompanying drawings illustrate a number of exemplary embodiments and are a part of the specification. Together with the following description, these drawings demonstrate and explain various principles of the present disclosure.

Figure 1:
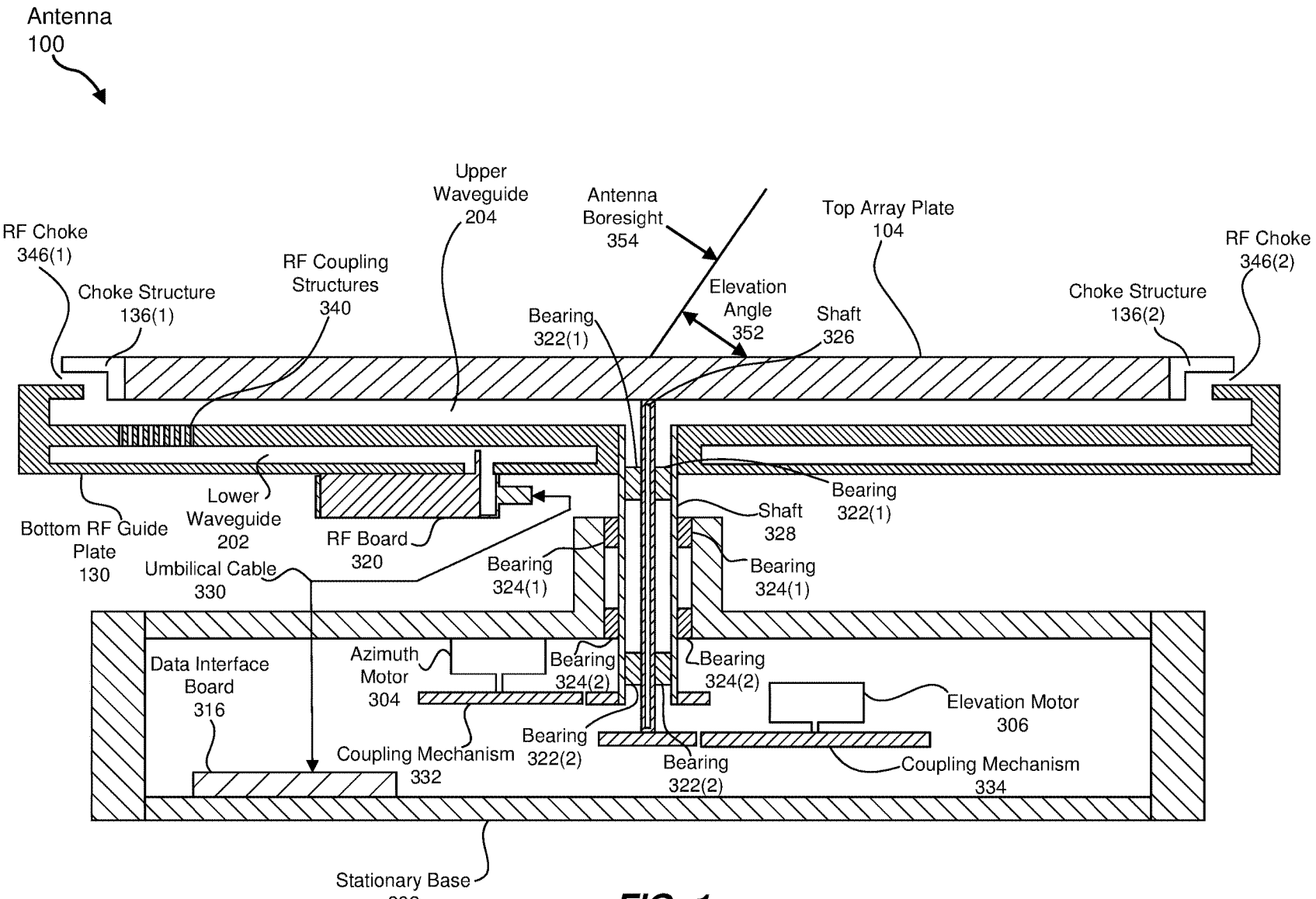
FIG. 1 is an illustration of an exemplary antenna that includes parallel waveguides in accordance with one or more embodiments of this disclosure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within this disclosure.

DETAILED DESCRIPTION OF EXEMPLARY EMBODIMENTS

The present disclosure is generally directed to apparatuses, systems, and methods for transferring RF signals between parallel waveguides in antennas. As will be explained in greater detail below, these apparatuses, systems, and methods may provide numerous features and benefits. A significant consideration of RF signal system design (e.g., RF antenna design) may be the system's ability to guide and/or direct RF signals while minimizing signal losses and interference. Some RF systems, for example, may be designed such that an RF signal is capacitively coupled between two parallel waveguides, as in certain low-profile mechanically steerable antennas (MSAs).

In some examples, an RF signal may be coupled between parallel waveguides (e.g., by way of coupling structures located in a plate or other planar structures that separate the waveguides). Such coupling structures and parallel waveguides may be found in MSAs. However, other types of antennas and RF waveguide systems may benefit from the application of the various embodiments of the coupling structures described. In some examples, increased efficiency in coupling the RF signal between the waveguides may reduce insertion loss associated with a reflector geometry incorporated in one or both waveguides, which may lead to increased efficiency and other benefits for the RF system.

The following will provide, with reference to FIGS. 1-9, detailed descriptions of exemplary apparatuses, systems, components, and structures for transferring RF signals between parallel waveguides in antennas. In addition, detailed descriptions of exemplary methods for transferring RF signals between parallel waveguides in antennas will be provided in connection with FIG. 10.

FIG. 1 illustrates a side cross-section of an exemplary low-profile steerable antenna 100 that incorporates and/or employs an RF board 320 for transmitting and/or receiving RF signals in connection with a lower waveguide 202 and an upper waveguide 204. In some examples, exemplary low-profile steerable antenna 100 may facilitate and/or support exchanging communications with remote antennas via a constellation of satellites. As illustrated in FIG. 1, exemplary steerable antenna 100 may each include and/or represent a stationary base 302, an azimuth motor 304, an elevation motor 306, a bottom RF guide plate 130, and a top array plate 104. In some examples, azimuth motor 304 may be fixably coupled and/or attached to stationary base 302, and elevation motor 306 may also be fixably coupled and/or attached to stationary base 302. Additionally or alternatively, bottom RF guide plate 130 may be rotatably coupled to stationary base 302 via a shaft 328, and top array plate 104 may be rotatably coupled to stationary base 302 via a shaft 326.

In some examples, azimuth motor 304 may control and/or direct the rotation and/or orientation of shaft 328 and/or bottom RF guide plate 130. For example, azimuth motor 304 may move and/or rotate bottom RF guide plate 130 about or around shaft 328. In this example, shaft 328 may establish and/or provide a fixed axis for rotational movement of bottom RF guide plate 130.

Additionally or alternatively, elevation motor 306 may control and/or direct the rotation and/or orientation of shaft 326 and/or top array plate 104. For example, elevation motor 306 may move and/or rotate top array plate 104 about or around shaft 326. In this example, shaft 326 may establish and/or provide a fixed axis for rotational movement of top array plate 104.

As illustrated in FIG. 1, azimuth motor 304 may interface directly with shaft 328 via a coupling mechanism 332, and elevation motor 306 may interface directly with shaft 326 via a coupling mechanism 334. In one example, coupling mechanism 332 may include and/or represent a gear, pulley, or belt system that enables azimuth motor 304 to control and/or rotate shaft 328. By doing so, azimuth motor 304 may be able to control and/or rotate bottom RF guide plate 130 to a specific orientation and/or position. Similarly, coupling mechanism 334 may include and/or represent a gear, pulley, or belt system that enables elevation motor 306 to control and/or rotate shaft 326. By doing so, elevation motor 306 may be able to control and/or rotate top array plate 104 to a specific orientation and/or position.

In some examples, shaft 328 may be hollow and/or form a hole or passage designed to accommodate shaft 326. For example, shaft 326 may rotatably couple top array plate 104 to stationary base 302 by passing though the hollow region, hole, and/or passage of shaft 328. In this example, shaft 328 may rotatably couple bottom RF guide plate 130 to stationary base 302 despite shaft 326 being located and/or positioned inside the hollow region, hole, and/or passage of shaft 328.

In some examples, shaft 326 and/or shaft 328 may be co-centered with respect to the mechanically steerable antenna, stationary base 302, top array plate 104, and/or bottom RF guide plate 130. In one example, shaft 326 and/or shaft 328 may provide, facilitate, and/or support low-friction spinning and/or rotation of top array plate 104 and/or bottom RF guide plate 130 around a fixed axis. Additionally or alternatively, shaft 326 and/or shaft 328 may provide, facilitate, and/or support a low moment of inertia for top array plate 104 and/or bottom RF guide plate 130. Such features may enable the mechanically steerable antenna to achieve high-speed handover from one satellite to another satellite.

In some examples, stationary base 302 may include and/or represent any type or form of structure, housing, and/or footing capable of supporting top array plate 104 and/or bottom RF guide plate 130. Accordingly, stationary base 302 may maintain and/or secure shafts 326 and 328 about which top array plate 104 and bottom RF guide plate 130, respectively, rotate.

Stationary base 302 may be of various shapes and/or dimensions. In some examples, base 302 may be circular and/or cylindrical. Additional examples of shapes formed by base 302 include, without limitation, ovoids, cubes, cuboids, spheres, spheroids, cones, prisms, variations or combinations of one or more of the same, and/or any other suitable shapes.

Stationary base 302 may be sized in a particular way to house and/or stabilize rotating co-axial plates and/or disks. Stationary base 302 may include and/or contain any of a variety of materials. Examples of such materials include, without limitation, metals, plastics, ceramics, polymers, composites, rubbers, variations or combinations of one or more of the same, and/or any other suitable materials.

In some examples, azimuth motor 304 and/or elevation motor 306 may each include and/or represent any type or form of motor capable of controlling and/or rotating top array plate 104 and/or bottom RF guide plate 130, respectively. In one example, azimuth motor 304 and/or elevation motor 306 may each include and/or represent a stepper motor. Additional examples of azimuth motor 304 and/or elevation motor 306 include, without limitation, servomotors, direct current (DC) motors, alternating current (AC) motors, variations or combinations of one or more of the same, and/or any other suitable motors.

Azimuth motor 304 and/or elevation motor 306 may be of various shapes and/or dimensions. In one example, azimuth motor 304 and/or elevation motor 306 may each be shaped as a cylinder. In another example, azimuth motor 304 and/or elevation motor 306 may each be shaped as a cube or cuboid.

Azimuth motor 304 and/or elevation motor 306 may be sized in a particular way to fit within an MSA. Azimuth motor 304 and/or elevation motor 306 may include and/or contain any of a variety of materials. Examples of such materials include, without limitation, metals, plastics, ceramics, polymers, composites, rubbers, variations or combinations of one or more of the same, and/or any other suitable materials.

In some examples, top array plate 104 and/or bottom RF guide plate 130 may each include and/or represent any type of form of plate and/or disk capable of transmitting and/or receiving RF communications. Top array plate 104 and/or bottom RF guide plate 130 may each be of various shapes and/or dimensions. In one example, top array plate 104 and/or bottom RF guide plate 130 may each be shaped as a disk and/or circle. Additional examples of shapes formed by top array plate 104 and/or bottom RF guide plate 130 include, without limitation, squares, rectangles, triangles, pentagons, hexagons, octagons, ovals, diamonds, parallelograms, variations or combinations of one or more of the same, and/or any other suitable shapes.

Top array plate 104 and/or bottom RF guide plate 130 may be sized in a particular way to fit within a mechanically steerable antenna. Top array plate 104 and/or bottom RF guide plate 130 may include and/or contain any of a variety of materials. Examples of such materials include, without limitation, metals, coppers, aluminums, steels, stainless steels, silver, variations or combinations of one or more of the same, and/or any other suitable materials.

In some examples, exemplary antenna 100 may include and/or incorporate bearing 324(1) and/or bearing 324(2) applied between shaft 326 and shaft 328. In one example, bearings 324(1) and 324(2) may provide, facilitate, and/or support free rotational movement for top array plate 104 and/or bottom RF guide plate 130 around a fixed axis. In this example, bearings 324(1) and 324(2) may be attached and/or fitted around the exterior of shaft 326. Additionally or alternatively, bearings 324(1) and 324(2) may be attached and/or fitted inside the hollow region, hole, and/or passage of shaft 328.

Additionally or alternatively, exemplary antenna 100 may include and/or incorporate bearing 322(1) and/or bearing 322(2) applied between shaft 328 and stationary base 302. In one example, bearings 322(1) and 322(2) may provide, facilitate, and/or support free rotational movement for bottom RF guide plate 130 around a fixed axis. In this example, bearings 322(1) and 322(2) may be attached and/or fitted around the exterior of shaft 328. Additionally or alternatively, bearings 322(1) and 322(2) may be attached and/or fitted inside a flange, ridge, and/or lip of stationary base 302. Examples of bearings 324(1), 324(2), 322(1), and 322(2) include, without limitation, ball bearings, roller bearings, plain bearings, jewel bearings, fluid bearings, magnetic bearings, flexure bearings, variations or combinations of one or more of the same, and/or any other suitable type of bearings.

In some examples, bearings 324(1) and 324(2) may maintain and/or support top array plate 104 and/or bottom RF guide plate 130 in a certain position relative to one another within the MSA. In such examples, bearings 324(1) and 324(2) may rotate top array plate 104 and/or bottom RF guide plate 130 relative to stationary base 302. Additionally or alternatively, bearings 322(1) and 322(2) may maintain and/or support bottom RF guide plate 130 in a certain position relative to stationary base 302. In these examples, bearings 322(1) and 322(2) may rotate bottom RF guide plate 130 relative to stationary base 302.

In some examples, exemplary steerable antenna 100 may include and/or incorporate RF board 320 coupled and/or attached to bottom RF guide plate 130. In one example, RF board 320 may generate and/or produce an RF signal for transmission to an overhead satellite. In this example, bottom RF guide plate 130 may form and/or incorporate a waveguide that directs the RF signal toward one or more slots and/or other RF coupling structures that facilitate and/or support the transmission to the overhead satellite. As illustrated in FIG. 1, exemplary steerable antenna 100 may provide a lower waveguide 202 that directs an RF signal generated by RF board 320 toward RF coupling structures 340, which facilitate and/or support the transmission of the RF signal.

In some examples, exemplary steerable antenna 100 may include and/or incorporate a data interface board 316 coupled and/or attached to stationary base 302. In one example, data interface board 316 may feed and/or source intermediate frequency data to RF board 320 via an umbilical cable 330. In this example, RF board 320 may then convert and/or integrate intermediate frequency data into the RF signal transmitted to the overhead satellite.

In some examples, data interface board 316 and/or RF board 320 may include and/or contain one or more processing devices and/or memory devices. Such processing devices may each include and/or represent any type or form of hardware-implemented processing device capable of interpreting and/or executing computer-readable instructions. In one example, such processing devices may access and/or modify certain software modules, applications, and/or data stored in the memory devices. Examples of such processing devices include, without limitation, physical processors, central processing units (CPUs), microprocessors, microcontrollers, Field-Programmable Gate Arrays (FPGAs) that implement softcore processors, Application-Specific Integrated Circuits (ASICs), Systems on a Chip (SoCs), portions of one or more of the same, variations or combinations of one or more of the same, and/or any other suitable processing devices.

Such memory devices may each include and/or represent any type or form of volatile or non-volatile storage device or medium capable of storing data, computer-readable instructions, software modules, applications, and/or operating systems. Examples of such memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory devices. In some examples, certain processing devices and memory devices may be considered and/or viewed as a single device and/or unit.

In some examples, data interface board 316 may provide intermediate frequency data by way of an umbilical cable to RF board 320, which modulates an RF reference wave to generate the RF signals that are subsequently fed to the lower cavity and/or lower waveguide 202 by an RF feed structure (e.g., pins, slots, and/or other RF coupling structures). In some examples, the RF feed structure and/or board may be fixably coupled to an outer surface (e.g., an underside) of the bottom RF guide plate. Some embodiments of the feed or launch structure are described in greater detail below in connection with FIGS. 2 and 3.

In some examples, top array plate 104 may include and/or incorporate choke structures 136(1) and 136(2) that, together with bottom RF guide plate 130, form RF chokes 346(1) and 346(2), respectively. In one example, RF chokes 346(1) and 346(2) may prevent and/or mitigate RF energy leakage or intrusion between the waveguide and an area outside the waveguide.

In some examples, top array plate 104 and/or bottom RF guide plate 130 may be positioned and/or oriented in certain ways to steer, direct, and/or aim a boresight (e.g., the axis of maximum gain of the antenna) in different directions. These positions and/or orientations of top array plate 104 and bottom RF guide plate 130 may be achieved for purposes of tracking an overhead satellite and/or switching between satellites.

In some examples, top array plate 104 and/or bottom RF guide plate 130 may include and/or represent various antennae elements, features, and/or tiles combined and/or configured as a single unit. In one example, the single unit may constitute and/or represent a directional antenna system capable of beamforming and/or spatial filtering in connection with transmitting and/or receiving communications.

In some embodiments, the top array plate may be 350-to-450 millimeters (mm) in diameter, and the bottom RF guide plate may be 345-to-445 mm in diameter. However, other sizes for the top array plate and the bottom RF guide plate may also be employed. In one example, a total height for the antenna, including the stationary base, may be approximately 100-to-120 mm, resulting in a low-profile antenna arrangement.

While the component of the steerable antenna to which the bottom RF guide plate and the top array plate are coupled is termed a "stationary base", such a base may be fixably coupled to the ground or to a movable platform, such as an airborne or ground-based vehicle. In either case, the stationary base may provide a reference frame within which the bottom RF guide plate and the top array plate may be oriented to provide connectivity to a satellite.

In some examples, the bottom RF guide plate and the top array plate may form RF cavities or waveguides that facilitate the transmission and/or reception of RF signals. More specifically, in some examples, the bottom RF guide plate may define and/or form a lower cavity. In addition, the lower cavity may connect to and/or be equipped with one or more openings or other features that form part of a feed and/or launch structure for introducing an RF signal into the lower cavity for transmission to a satellite by the antenna and/or for receiving an RF signal from a satellite by the antenna via the lower cavity. While one RF feed is depicted in FIG. 1, multiple RF feeds and associated circuitry may be employed in other embodiments.

In some examples, one or more coupling structures (e.g., one or more slots in the bottom RF guide plate, possibly in combination with other components and/or materials, such as metal patches, dielectric materials, and/or the like) may couple the lower cavity with an upper cavity defined by the combination of the bottom RF guide plate and the top array plate. For example, RF coupling structures 340 may effectively couple lower waveguide 202 and upper waveguide 204 together such that RF signals launched by RF board 320 are able to traverse from lower waveguide 202 to upper waveguide 204 via RF coupling structures 340. Additionally or alternatively, RF coupling structures 340 may effectively couple lower waveguide 202 and upper waveguide 204 together such that RF signals received by antenna 100 are able to traverse from upper waveguide 204 to lower waveguide 202 via RF coupling structures 340.

In some examples, the top array plate may include a holding clamp at a perimeter about the top array plate for holding a printed circuit board (PCB). In one example, the PCB may include and/or incorporate an array of antenna array elements (e.g., patch antenna elements, spiral antenna array elements, and/or the like) positioned for transmission and/or reception of RF signals between the antenna and the satellite. In this example, an edge region of the top array plate and the bottom RF guide plate may form a waveguide choke flange and associated slot (or other such RF coupling structures) that substantially restrict leakage of RF energy over an operating range of frequencies of the RF signals being transmitted and received by the antenna. The choke flange and/or slot may thus form a contactless interface between the top array plate and the bottom RF guide plate to facilitate relative changes in orientation between the two plates.

In operation, for transmitting RF signals from the antenna (e.g., to a satellite), an RF feed and/or launch structure may introduce the RF signal into the lower cavity for propagation within the lower cavity (e.g., as a transverse electric mode signal). In response to the coupling structures of the bottom RF guide plate, the RF signal in the lower cavity may traverse into the upper cavity (e.g., as a transverse electromagnetic mode signal). In some embodiments, the resulting RF signal may be directed along a particular direction determined by the orientation of the bottom RF guide plate based at least in part on the arrangement, location, and/or orientation of the coupling structures as well as the RF feed into the lower cavity. Moreover, the RF signal in the upper cavity may interact with the elements of the antenna array that facilitate transmitting the RF signal to the satellite. In at least one example, antenna 100 may exhibit and/or control an elevation angle 352 of an antenna boresight 354 (the axis along which the RF signal is transmitted). In this example, elevation angle 352 of antenna boresight 354 may be determined by the alignment of the array elements relative to the direction along which the RF signal in the upper cavity is aligned.

In the embodiments described above, the orientation of the bottom RF guide plate (e.g., due to the positioning and/or alignment of the RF feed and/or the coupling structure) and the top array plate (e.g., due to the arrangement and/or structure of the element array) may determine and/or control the orientation (azimuth and elevation) of antenna boresight 354 along which the RF signal is transmitted. In some examples, the same change in the orientation of both the bottom RF guide plate and the top array plate may result in the same change in the azimuth angle of antenna boresight 354 without a change in the elevation angle of antenna boresight 354. In those examples, a change in the orientation of the top array plate without a change in orientation of the bottom RF guide plate may result in a change of the same amount of elevation of antenna boresight 354. Additionally, in some embodiments, such a change in orientation of the top array plate alone may result in a change in orientation of azimuth of the antenna boresight (e.g., by half the amount of the change in orientation of the elevation of the antenna boresight).

In operating the antenna to receive an RF signal (e.g., from the satellite aligned with the antenna boresight), excitation of elements of the antenna array in response to the received signal may cause an RF signal (e.g., a transverse electromagnetic mode signal) to propagate within the upper cavity. In some examples, the array elements being excited by the received RF signal (e.g., receiving elements) may be different from the array elements responsible for transmitting an RF signal to the satellite (e.g. transmitting elements). Further, in some embodiments, the receiving elements and the transmitting elements may be interspersed such that they occupy the same antenna aperture, as defined by the top array plate.

Further, the RF signal propagating within the upper cavity may be coupled into the lower cavity by the one or more coupling structures of the bottom RF guide plate, resulting in an RF signal (e.g., a transverse electric mode signal) propagating in the lower cavity, which may be sensed by the RF board via the RF feed, launch structure, and/or additional components. The RF board may demodulate and/or convert the sensed signal into an intermediate frequency signal that is processed further via data interface board 316.

While embodiments of the antenna, as described herein, generally presume their use for communication with low Earth orbit (LEO) satellites, communication with medium Earth orbit (MEO) satellites, communication with satellites in other orbits, and communication with other devices (e.g., aircraft) may also benefit from the various examples discussed herein.

In FIG. 1, RF board 320 may implement and/or employ a patch-fed structure for launching and/or receiving RF signals. For example, a patch structure of RF board 320 may launch an RF signal into lower waveguide 202 and/or receive an RF signal from lower waveguide 202. In particular, the lower cavity that serves as the waveguide may be substantially circular in one dimension and/or may possess a substantially constant height in another dimension. Also, while antenna 100 in FIG. 1 depicts a single RF feed structure for launching the RF signal into the lower cavity, two or more such feed structures (e.g., two or more patch structures, as described below) may be employed in some embodiments of antenna 100.

Figure 2:
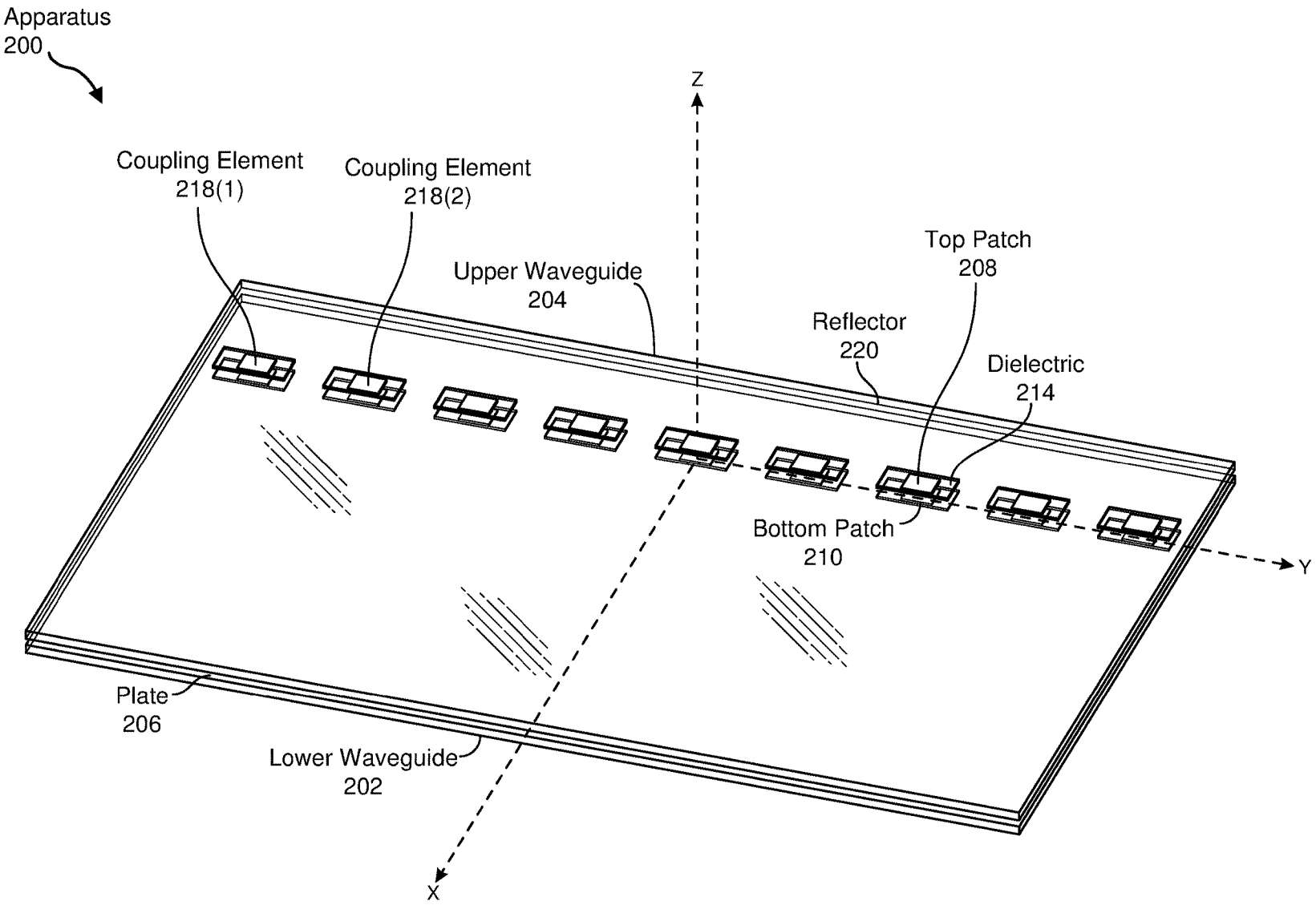
FIG. 2 is an illustration of an exemplary apparatus for transferring radio frequency (RF) signals between parallel waveguides in antennas in accordance with one or more embodiments of this disclosure.

FIG. 2 illustrate an exemplary apparatus 200 for transferring RF signals between lower waveguide 202 and upper waveguide 204 configured and/or oriented to be substantially parallel to one another. As illustrated in FIG. 2, apparatus 200 may include and/or represent lower waveguide 202 and upper waveguide 204 positioned substantially parallel to one another. In some examples, apparatus 200 may also include and/or represent a plate 206 coupled between lower waveguide 202 and upper waveguide 204. Additionally or alternatively, apparatus 200 may be included and/or incorporated into antenna 100 to facilitate establishing and/or maintaining communication with passing satellites.

In one example, plate 206 may include and/or contain coupling elements 120(1) and 120(2), among others, that facilitate transferring RF signals between lower waveguide 202 and upper waveguide 204. Additionally or alternatively, coupling elements 120(1) may be fitted and/or inserted into holes and/or openings formed by or in lower waveguide 202 and/or upper waveguide 204.

In some examples, lower waveguide 202 may include and/or contain a reflector 220 designed to reflect and/or bounce RF signals back in the opposite direction. Additionally or alternatively, upper waveguide 204 may include and/or contain a reflector 220 designed to reflect and/or bounce RF signals back in the opposite direction. For example, some RF signals traversing and/or travelling through lower waveguide 202 or upper waveguide 204 in the negative x-direction in FIG. 2 may reach reflector 220. In this example, such RF signals may be reflected and/or bounced back in the positive x-direction in FIG. 2 by reflector 220. In one embodiment, reflector 220 may be applied to an end of lower waveguide 202 and/or upper waveguide 204 positioned proximate to the coupling elements.

In some examples, lower waveguide 202 may be configured and/or designed to direct certain RF signals in a specific direction, and upper waveguide 204 may be configured and/or designed to direct such RF signals in the opposite direction. For example, lower waveguide 202 may be configured and/or designed to direct RF signals being transmitted by antenna 100 in the negative x-direction in FIG. 2 toward coupling elements 218(1) and 208(2) and/or reflector 220. In contrast, upper waveguide 204 may be configured and/or designed to direct such RF signals being transmitted by antenna 100 in the positive x-direction in FIG. 2 away from coupling elements 218(1) and 208 and/or reflector 220.

Similarly, upper waveguide 204 may be configured and/or designed to direct RF signals received by antenna 100 in the negative x-direction in FIG. 2 toward coupling elements 218(1) and 208(2) and/or reflector 220. In contrast, lower waveguide 202 may be configured and/or designed to direct such RF signals received by antenna 100 in the positive x-direction in FIG. 2 away from coupling elements 218(1) and 208 and/or reflector 220.

In some examples, lower waveguide 202 and/or upper waveguide 204 may each include and/or represent any type or form of structure and/or feature capable of guiding and/or directing RF signals. In one example, lower waveguide 202 and/or upper waveguide 204 may each include and/or represent a hollow metallic pipe and/or disk that carries radio waves in one direction and/or another. In this example, lower waveguide 202 and/or upper waveguide 204 may each serve and/or function as a transmission line. Accordingly, lower waveguide 202 and/or upper waveguide 204 may each constitute a link in the transmission path of RF signals sent from and/or received by an antenna that includes antenna 100.

Lower waveguide 202 and/or upper waveguide 204 may each include and/or represent any of various materials. Examples of such materials include, without limitation, coppers, golds, steels, alloys, silvers, nickels, brass, aluminums, silicon, glasses, polymers, variations or combinations of one or more of the same, and/or any other suitable materials.

In some examples, lower waveguide 202 and/or upper waveguide 204 may each be of any suitable shape and/or dimensions. In one example, lower waveguide 202 and/or upper waveguide 204 may include and/or form a hollow cylinder and/or cuboid. Accordingly, lower waveguide 202 may maintain a cylindrical and/or rectangular shape that extends across certain parts of the corresponding antenna system. Additional examples of shapes formed by lower waveguide 202 and/or upper waveguide 204 include, without limitation, ovoids, cubes, cuboids, spheres, spheroids, cones, prisms, variations or combinations of one or more of the same, and/or any other suitable shapes.

In one embodiment, plate 206 may include and/or represent a metal plate. In another embodiment, plate 206 may include and/or represent a dielectric substrate with metallic outer layers.

In some examples, plate 206 may include and/or incorporate top patch 208, bottom patch 210, and/or dielectric 214. For example, plate 206 may include and/or represent a circuit board with copper layers coupled to opposing sides of dielectric 214. Plate 206 may include and/or contain a variety of materials. Some of these materials may conduct electricity. Other materials included in plate 206 may insulate the conductive materials from one another.

In some examples, plate 206 may include and/or incorporate insulating material that facilitates mounting (e.g., mechanical support) and/or interconnection (e.g., electrical coupling) of electrical and/or electronic components. In one example, plate 206 may include and/or represent a printed circuit board. Various components may be laminated, etched, attached, and/or otherwise coupled to plate 206.

As illustrated in FIG. 2, plate 206 may include and/or represent dielectric 214 that electrically insulates top patch 208 and/or bottom patch 210 from one another. In some examples, dielectric 214 may be disposed, laid out, and/or applied as planes between the layers on which top patch 208 and/or bottom patch 210 are formed and/or coupled. In such examples, dielectric 214 may be a poor conductor of electricity and/or may be polarized by an applied electric field. Examples of dielectric 214 include, without limitation, porcelains, glasses, plastics, industrial coatings, silicon, germanium, gallium arsenide, mica, metal oxides, silicon dioxides, sapphires, aluminum oxides, polymers, ceramics, variations or combinations of one or more of the same, and/or any other suitable dielectric materials.

In some examples, the coupling elements included in plate 206 and/or inserted into holes formed in lower waveguide 202 and/or upper waveguide 204 may each include and/or represent one or more components and/or features. For example, each coupling element in apparatus 200 may include and/or represent a top patch 208, a bottom patch 210, and/or a dielectric 214. In this example, top patch 208 and/or bottom patch 210 may be coupled to dielectric 214. As one example, top patch 208 and/or bottom patch 210 may be etched and/or milled into metallic layers of a circuit board that includes dielectric 214. In another example, top patch 208 and/or bottom patch 210 may be attached and/or adhered to dielectric 214.

In some examples, top patch 208 and/or bottom patch 210 may each include and/or represent any type or form of suitable conductive pad capable of radiating and/or resonating RF signals. In one example, top patch 208 and/or bottom patch 210 may include and/or represent a metallic pad mounted to, etched on, and/or milled on dielectric 214. For example, top patch 208 and/or bottom patch 210 may be photolithographically fabricated into a layer of a circuit board that includes dielectric 214. Top patch 208 and/or bottom patch 210 may include and/or represent any of various conductive materials. Examples of such conductive materials include, without limitation, coppers, golds, steels, alloys, silvers, nickels, aluminums, variations or combinations of one or more of the same, and/or any other suitable type of conductive materials.

In some examples, top patch 208 and/or bottom patch 210 may be of any suitable shape and/or dimensions. In one example, top patch 208 and/or bottom patch 210 may include and/or form a planar rectangular, square, circular, and/or triangular shape. Additional examples of shapes formed by top patch 208 and/or bottom patch 210 include, without limitation, pentagons, hexagons, octagons, ovals, diamonds, parallelograms, variations or combinations of one or more of the same, and/or any other suitable shapes. In one embodiment, at least one dimension (e.g., the length) of top patch 208 and/or bottom patch 210 may be approximately one half of the wavelength of the RF signals launched and/or received by antenna 100. Although not necessarily illustrated in this way in FIG. 2, one or more of the coupling elements in apparatus 200 may include and/or incorporate multiple patches (e.g., an array of patches), potentially widening the bandwidth of the overall structure.

In some examples, bottom patch 210 may face and/or be oriented toward lower waveguide 202. In such examples, bottom patch 210 may be exposed to lower waveguide 202 and/or obscured from upper waveguide 204. Additionally or alternatively, top patch 208 may face and/or be oriented toward upper waveguide 204. In such examples, top patch 208 may be exposed to upper waveguide 204 and/or obscured from lower waveguide 202.

In some examples, the coupling elements may include and/or represent a slot that interfaces the lower waveguide and/or the upper waveguide. For example, dielectric 214 may be positioned between a lower slot formed in lower waveguide 202 and an upper slot formed in upper waveguide 204 such that the lower patch is exposed to the lower waveguide via the lower slot and the upper patch is exposed to the upper waveguide via the upper slot. In one example, dielectric 214 may be incorporated in plate 206. In this example, dielectric 214 may be exposed around bottom patch 210 facing lower waveguide 202 and/or may be exposed around top patch 208 facing upper waveguide 204.

In some examples, the coupling elements included in plate 206 and/or inserted into holes formed in lower waveguide 202 and/or upper waveguide 204 may be positioned at a specific distance from an end of lower waveguide 202 and/or an end of upper waveguide 204. For example, the specific distance between the coupling elements and the ends of lower waveguide 202 and/or upper waveguide 204 may be a quarter wavelength of the RF signals traversing and/or travelling through lower waveguide 202 and/or upper waveguide 204.

FIG. 2 is a perspective view of an embodiment of a structure for coupling parallel waveguides (e.g., a lower waveguide or cavity and an upper waveguide or cavity, such as those of the MSA of FIG. 1). In this embodiment, a middle (e.g., metal) plate is employed to separate the upper cavity and the lower cavity. This middle plate may be included and/or incorporated in bottom RF guide plate 308 in FIG. 1 (sometimes referred to as the "azimuth plate"). This middle plate may define a number of holes or slots aligned (e.g., along the y-axis, as depicted in FIG. 2) some distance (e.g., a quarter-wavelength of the RF signal being coupled) away from a reflector area, which includes a closed end of each of the upper cavity and the lower cavity. In some examples, the reflector may be positioned along an end of the upper and lower cavities (e.g., parallel to the y-axis toward the end of the cavities in the negative x-direction) and/or may serve as an RF short for each cavity.

Each slot or hole of the middle plate may be occupied or filled, completely or partially, by a dielectric material. Additionally or alternatively, a metallic (e.g., copper) patch may be printed on or adhered to each side of each portion of dielectric material (e.g., resulting in a top patch on the positive z-side and a bottom patch on the negative z-side). The dielectric in conjunction with the patches may form and/or create a capacitive coupling between the upper and lower cavities. While the shape of each patch is shown in FIG. 2 as rectangular, other shapes for the patches (e.g., square, circular, and so on) may be employed in other embodiments. Also, in some examples, the size of the patches, dielectric material, and/or slots may be determined based on the wavelengths of the RF signals to be coupled between the upper and lower cavities.

Figure 3:
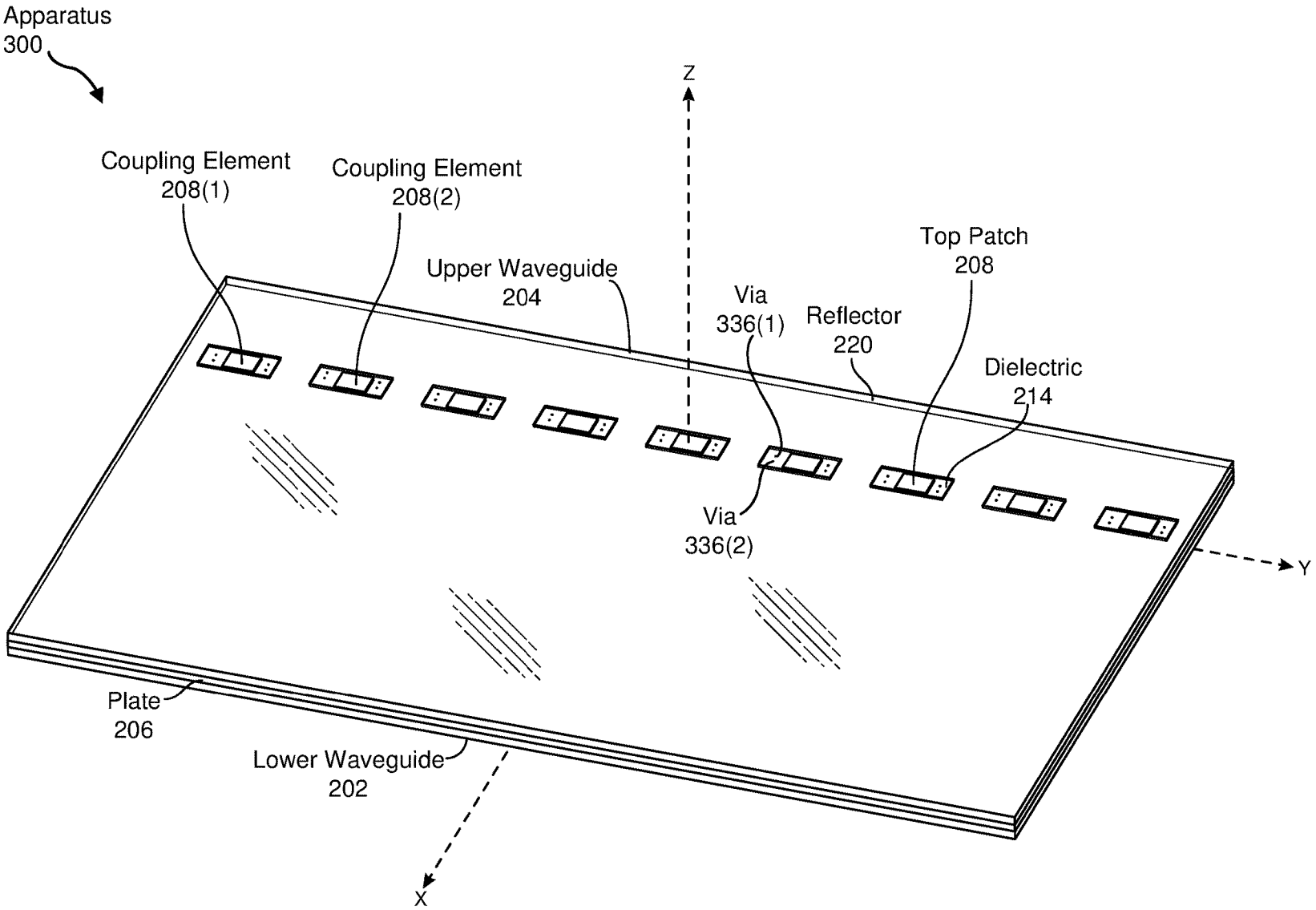
FIG. 3 is an illustration of an additional exemplary apparatus for transferring RF signals between parallel waveguides in antennas in accordance with one or more embodiments of this disclosure.

FIG. 3 illustrates an exemplary apparatus 300 for transferring RF signals between lower waveguide 202 and upper waveguide 204 configured and/or oriented to be substantially parallel to one another. As illustrated in FIG. 3, apparatus 300 may include many, if not all, of the components and/or features shown in apparatus 200 and/or described in connection with FIG. 2. In some examples, apparatus 300 may include and/or represent various coupling elements, such as coupling elements 218(1) and 208 (2), that facilitate transferring RF signals between lower waveguide 202 and upper waveguide 204. Additionally or alternatively, apparatus 300 may be included and/or incorporated into antenna 100 to facilitate establishing and/or maintaining communication with passing satellites.

In one example, some or all of these coupling elements may include and/or incorporate conductive vias disposed through the corresponding dielectrics. For example, a coupling element in apparatus 300 may include and/or represent vias 336(1) and 326(2) disposed through a dielectric around a lower patch and/or an upper patch. In this example, vias 336(1) and 326(2) as well as other vias may be arranged to substantially surround and/or encompass the lower patch and/or upper patch.

FIG. 3 is a perspective view of another embodiment of a coupling structure that, similar to the structure of FIG. 2, provides a capacitive coupling solution. However, instead of a metallic middle plate, a planar structure (e.g., a board or plate) of dielectric material may be employed to separate the upper and lower cavities. In some embodiments, a metal (e.g., copper) patch may be printed or plated on each side of the planar section to operate as corresponding sides of the upper and lower cavity with the exception of rectangular areas that serve as slots to couple the upper and lower cavities.

In some examples, these slots may be aligned along and/or parallel to the reflector, residing some distance (e.g., a quarter-wavelength of the RF signal to be coupled between the cavities) away from the reflector. Additionally, a top and bottom metallic (e.g., copper) patch (e.g., rectangular, square, circular, or the like) may be printed or otherwise adhered to corresponding sides of the dielectric plate to operate in conjunction with the dielectric to provide capacitive coupling. Moreover, in some embodiments, each slot may be surrounded by a plurality of vertically oriented metallic vias electrically connecting the two metallic sides of the dielectric plate together around the dielectric slots to reduce or eliminate signal leakage into the surrounding substrate. In some embodiments, a via-to-via distance around each dielectric slot may be in the range between the wavelength of the RF signal divided by 20 and the wavelength of the RF signal divided by 8 to facilitate at least acceptable reduction or elimination of signal leakage.

Figure 4:
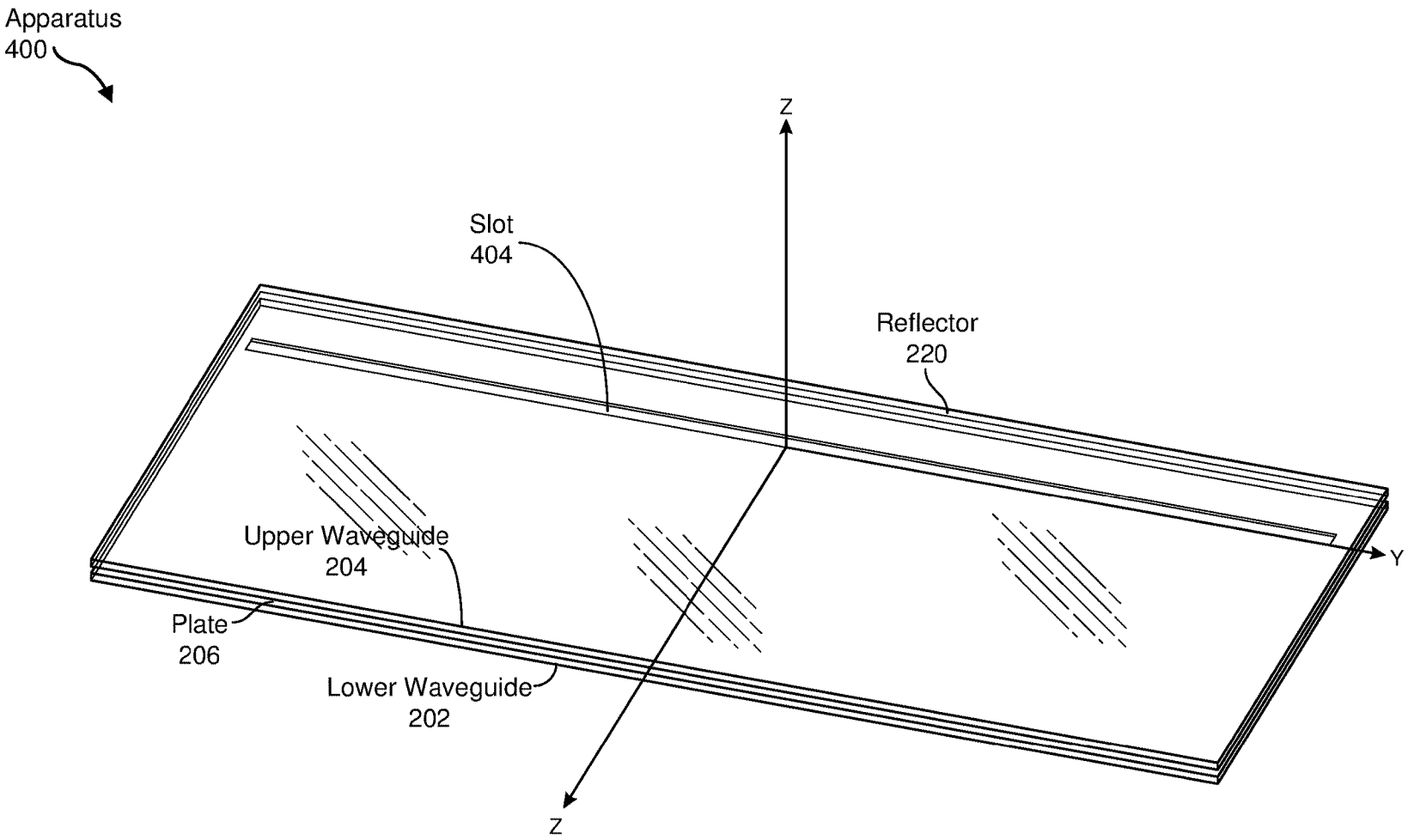
FIG. 4 is an illustration of an additional exemplary apparatus for transferring RF signals between parallel waveguides in antennas in accordance with one or more embodiments of this disclosure.

FIG. 4 illustrates an exemplary apparatus 400 for transferring RF signals between lower waveguide 202 and upper waveguide 204 configured and/or oriented to be substantially parallel to one another. As illustrated in FIG. 4, apparatus 400 may include and/or represent at least one coupling elements, such as slot 404, that facilitates transferring RF signals between lower waveguide 202 and upper waveguide 204. Additionally or alternatively, apparatus 400 may be included and/or incorporated into antenna 100 to facilitate establishing and/or maintaining communication with passing satellites.

FIG. 4 is a perspective view of an embodiment of a simple coupling structure that does not employ an explicit capacitive effect but instead involves the use of a slot defined in a metallic middle plate separating the lower cavity and the upper cavity. In some examples, slot 404 in FIG. 4 may be narrower (e.g., in the x-direction) than the slots employed in FIGS. 2 and 3. In one example, a distance of slot 404 from the edge of the reflector may be a quarter wavelength of the RF signals being coupled between the lower and upper cavities to reduce and/or eliminate the amount of RF signal reflected by the reflector back toward slot 404. In another example, slot 404 may be located at an end of the middle plate (in the negative x-direction) adjacent the reflector. In some embodiments, additional supportive structures, such as posts or other mechanical structures connecting the middle plate to another mechanical component (e.g., a lower planar portion of bottom RF guide plate 130 defining the lower cavity), may be provided.

Figure 5:
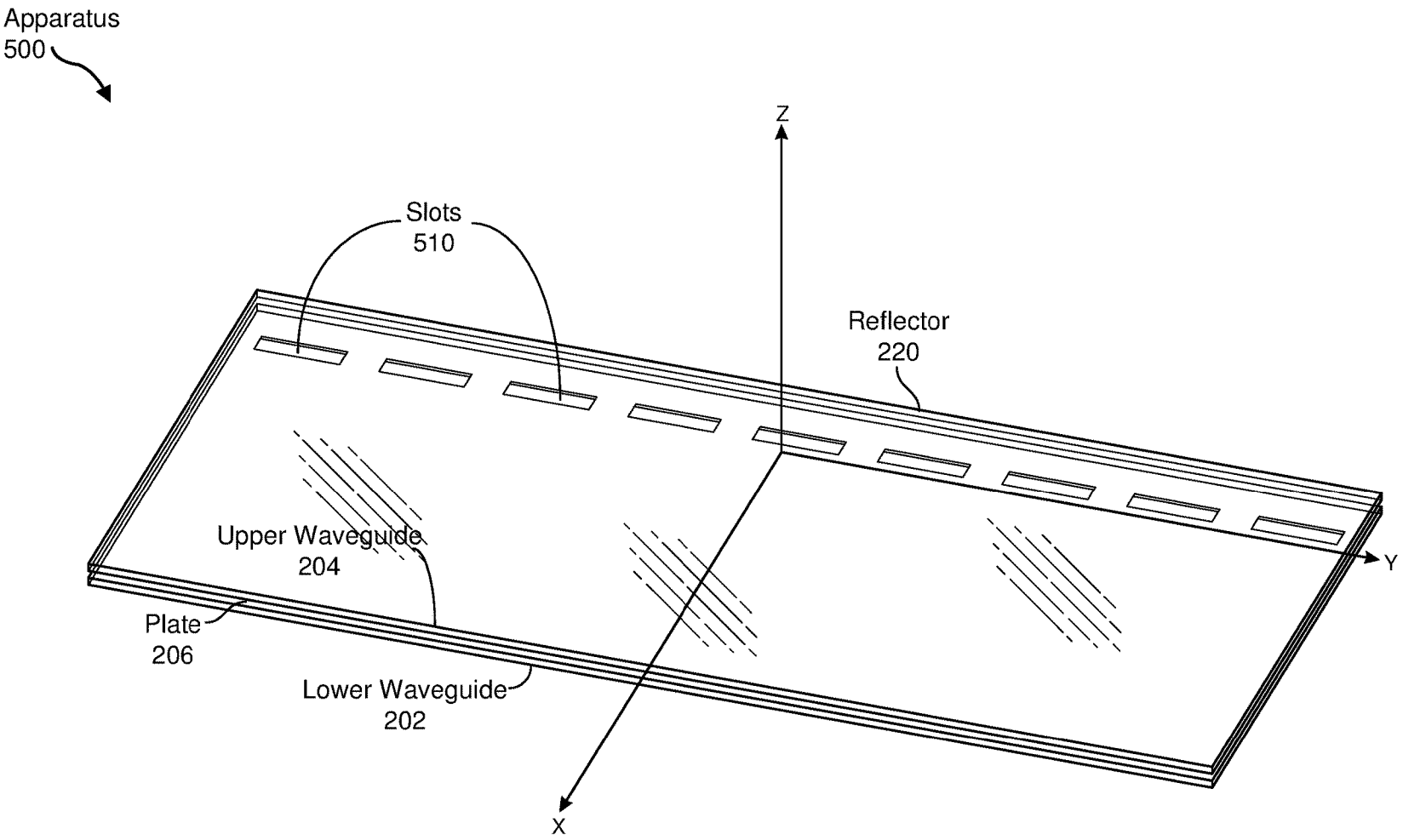
FIG. 5 is an illustration of an additional exemplary apparatus for transferring RF signals between parallel waveguides in antennas in accordance with one or more embodiments of this disclosure.

FIG. 5 illustrates an exemplary apparatus 500 for transferring RF signals between lower waveguide 202 and upper waveguide 204 configured and/or oriented to be substantially parallel to one another. As illustrated in FIG. 5, apparatus 500 may include and/or represent at least one coupling elements, such as slots 510, that facilitate transferring RF signals between lower waveguide 202 and upper waveguide 204. Additionally or alternatively, apparatus 500 may be included and/or incorporated into antenna 100 to facilitate establishing and/or maintaining communication with passing satellites.

FIG. 5 is a perspective view of another non-capacitive coupling structure in the middle plate that defines multiple slots (e.g., short slots replacing the single slot of FIG. 4) that couple RF signals between the lower and upper cavities. As with slot 404 in FIG. 4, each of smaller slots 510 may be positioned a quarter wavelength of the RF signals from reflector 220 in at least some embodiments. In addition, in some examples, adjacent slots (e.g., along the Y-axis) may be spaced and/or distanced a half wavelength of the RF signals away from each other, as measured from the center of the slots.

Figure 6:
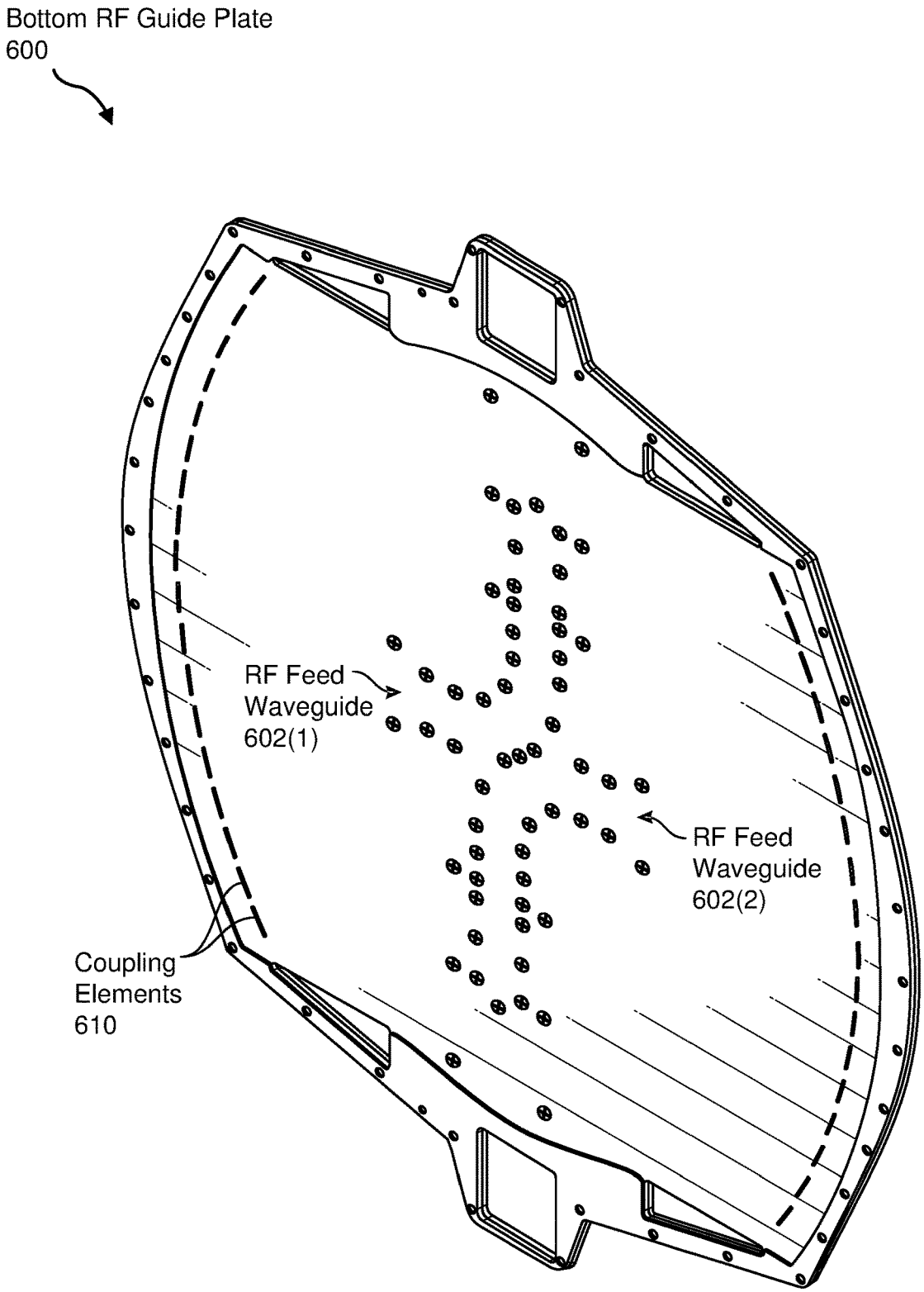
FIG. 6 is an illustration of an exemplary bottom RF guide plate capable of incorporating at least a portion of the apparatuses in FIGS. 2-5 in accordance with one or more embodiments of this disclosure.
Figure 7:
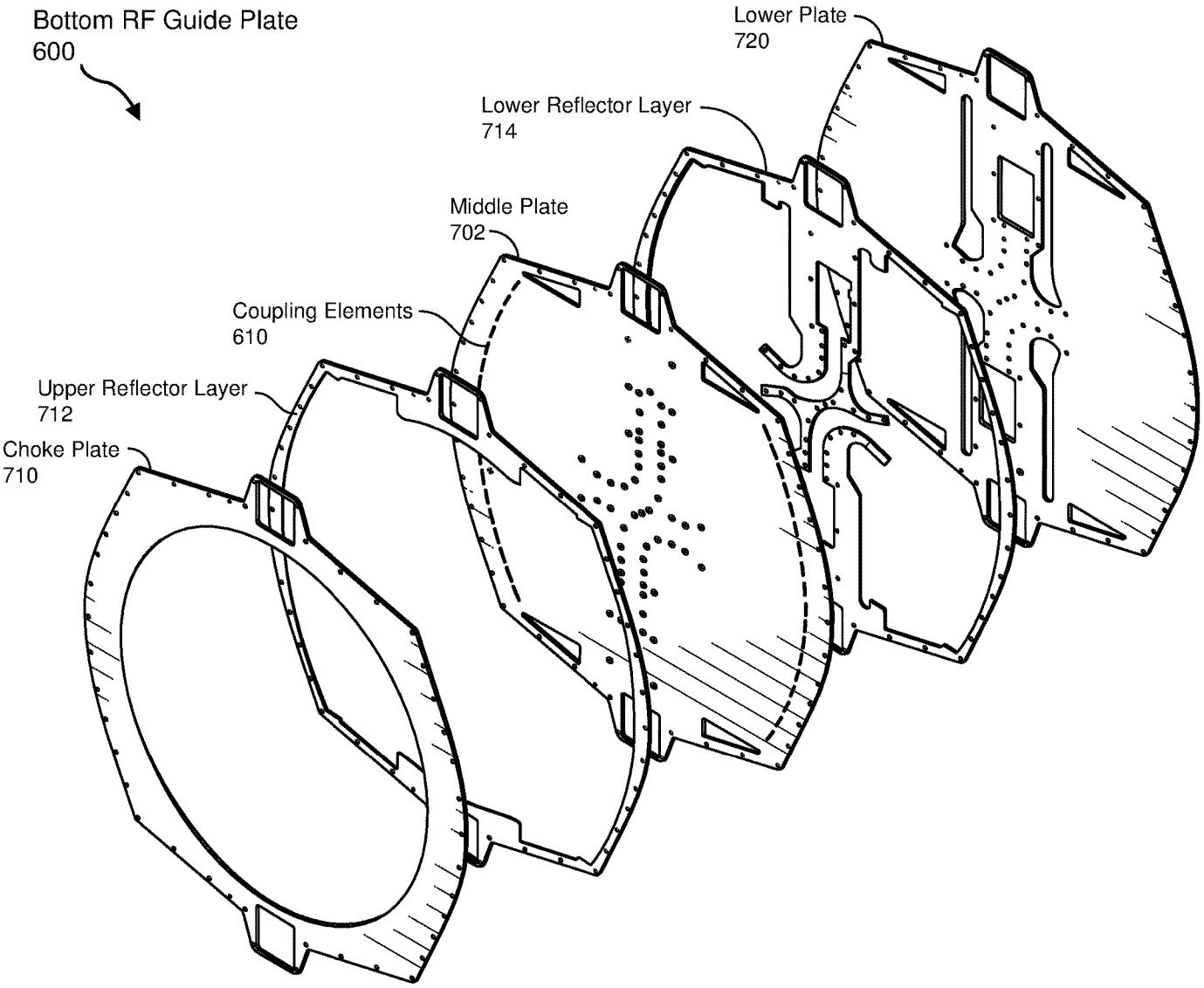
FIG. 7 is another illustration of the exemplary bottom RF guide plate capable of incorporating at least a portion of the apparatuses in FIGS. 2-5 in accordance with one or more embodiments of this disclosure.
Figure 8:
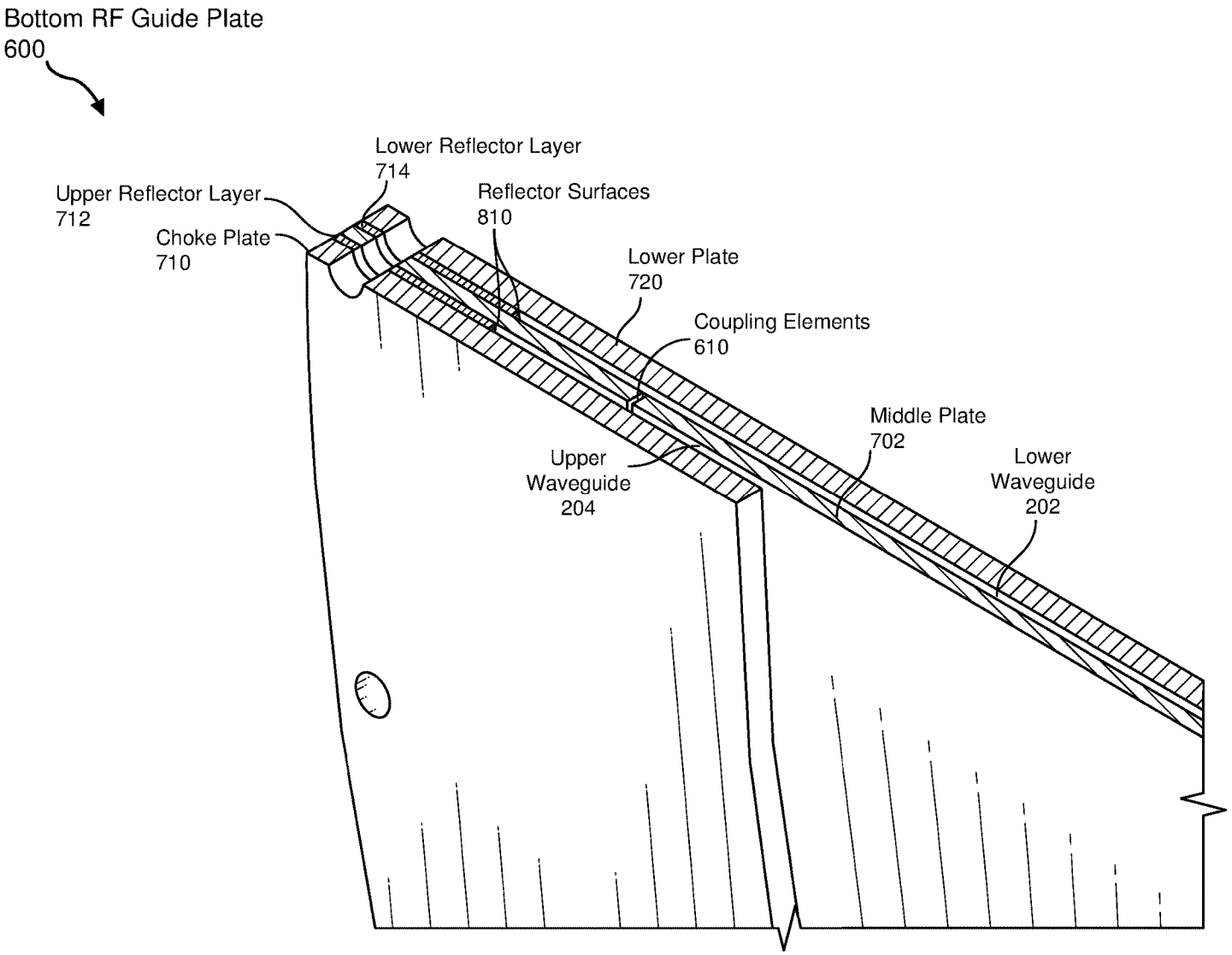
FIG. 8 is another illustration of the exemplary bottom RF guide plate capable of incorporating at least a portion of the apparatuses in FIGS. 2-5 in accordance with one or more embodiments of this disclosure.

In the examples of FIGS. 2-5, the slots may be illustrated as elongate, substantially rectangular, and/or linearly arranged. However, in other embodiments, the slots may describe other shapes, such as a parabolic arc along the longer extent of each slot. For example, an embodiment of bottom RF guide plate 130 in FIG. 1 may employ the slots of the coupling structure in FIG. 5 as illustrated in FIGS. 6-8. However, in other examples, any of the other coupling structures discussed above in connection with FIGS. 2-4 may also be utilized in a similar parabolic arrangement in the bottom RF guide plate.

FIG. 6 illustrates a perspective view of an exemplary assembled bottom RF guide plate 600 that employs the exemplary coupling structure of FIG. 5. In some examples, bottom RF guide plate 600 may include and/or incorporate two separate RF feed waveguides 602(1) and 602(2). In such examples, RF feed waveguides 602(1) and 602(2) may be communicatively coupled to an RF feed structure for transmitting and/or receiving RF signals. Communicatively coupled with each of these feed waveguides may be separate groups of coupling elements 610 shaped and/or arranged as a parabolic arc relative to its corresponding RF feed waveguide. Coupling elements 610 may include and/or represent any of the coupling structures described above in connection with FIGS. 2-5, including one or more slots and/or dielectric-separated metal patches. In one embodiment, bottom RF guide plate 600 in FIG. 6 may be included and/or incorporated into antenna 100 to facilitate establishing and/or maintaining communication with passing satellites.

FIG. 7 illustrates an exploded perspective view of bottom RF guide plate 600 in FIG. 6. In this example, bottom RF guide plate 600 may include and/or represent a lower (metal) plate 720, a middle plate 702 that includes the coupling elements 610, and a choke plate 710. The assembly for bottom RF guide plate 600, as depicted in FIG. 6, may lack and/or omit choke plate 710 so that coupling elements 610 are more readily displayed. In addition, bottom RF guide plate 600 may include and/or represent a lower reflector layer 714 coupled between lower plate 720 and middle plate 702. In one example, lower reflector layer 714 may serve and/or function as a spacer between the lower and middle plates to form the lower cavity (e.g., lower waveguide 202).

In one example, bottom RF guide plate 600 may include and/or represent an upper reflector layer 712 coupled between middle plate 702 and choke plate 710. In this example, upper reflector layer 712 may serve and/or function as a spacer between the middle and choke plates to form the upper cavity (e.g., upper waveguide 204). As the names suggest, lower reflector layer 714 and upper reflector layer 712 may include and/or incorporate an RF reflector for each of the sets of slots and/or other coupling structures for the lower and upper cavities, respectively. In some embodiments, choke plate 710 may serve and/or function as a choke interface (e.g., to limit RF signal leakage) within which the top array plate resides and/or rotates relative to bottom RF guide plate 600, as discussed above in conjunction with antenna 100 in FIG. 1.

FIG. 8 illustrates a close-up cross-section of bottom RF guide plate 600 in FIG. 6. As illustrated in FIG. 6, lower reflector layer 714 may serve and/or function as the spacer between lower plate 720 and middle plate 702 to define the lower cavity or waveguide. In some examples, upper reflector layer 712 may serve and/or function as the spacer between middle plate 702 and choke plate 710 to form the upper cavity or waveguide. In one example, bottom RF guide plate 600 may include and/or represent reflector surfaces 810 placed and/or applied within the lower and upper cavities. Additionally or alternatively, the coupling structures may be depicted as being located and/or positioned some distance (e.g., a quarter wavelength of the RF signals being transmitted and/or received) from the reflectors (e.g., to reduce or eliminate RF signal reflections being coupled between the lower and upper cavities).

In view of at least some of the embodiments discussed above, structures for coupling two parallel waveguides, such as the upper and lower cavities of antenna 100 in FIG. 1, may reduce insertion loss associated with the transition between the waveguides. This reduction, in turn, may facilitate a relatively smaller antenna aperture that possibly reduces the overall size, weight, and/or cost of the antenna.

Figure 9:
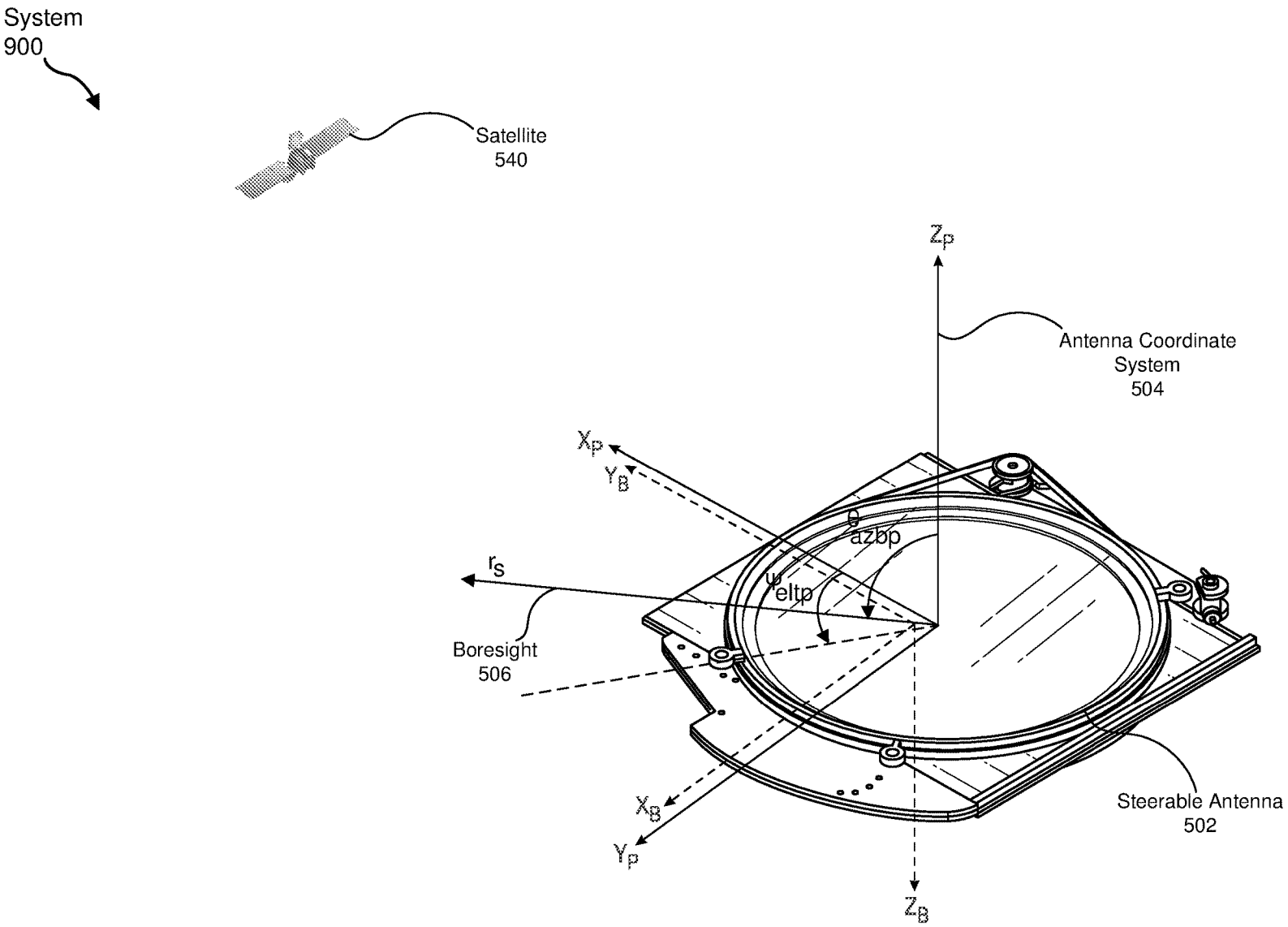
FIG. 9 is an illustration of an exemplary system that includes a satellite and a low-profile high-speed steerable antenna with independently rotatable plates according to one or more embodiments of this disclosure.

FIG. 9 is an illustration of an exemplary system 900 in which a steerable antenna 502 tracks a satellite 540 passing overhead. As illustrated in FIG. 9, steerable antenna 502 may steer, direct, and/or aim a boresight 506 in a certain direction in an effort to track and/or follow satellite 540. In some examples, steerable antenna 502 may steer, direct, and/or aim boresight 506 in accordance with an antenna coordinate system 504. In one example, antenna coordinate system 504 may implement and/or operate an overall pointing formula of $(\theta_{el_m},\psi_{az_m})=f(\theta_{eltp},\psi_{azbp})$, which facilitates mapping angles of boresight 506 to the displacement angles of the azimuth and elevation motors. This pointing formula may lead to an azimuth formula of $$\theta = \operatorname{asin}\left(2\sin\left(\frac{\theta_r}{2}\right)\right)$$

and/or an elevation formula of $$\phi = \left(\frac{\theta_r}{2} + \text{sign}(\theta_r) \times 90\right).$$

As a specific example, satellite 540 may be located at and/or passing through an azimuth angle of 0 degrees and an elevation angle of 37 degrees. In this example, for the worst case scenario of travelling within 53 degrees of the zenith, steerable antenna 502 may compute and/or determine the angular displacement of two plates as elevation angle=37°→$\theta_r$=47°→$\theta_{el_m}$=47° and azimuth angle=0°→$\phi$=113°→$\theta_{az_m}$=23°.

As another example, satellite 540 may be located at and/or passing through an azimuth angle of 180 degrees and an elevation angle of 37 degrees. In this example, for the worst case scenario of travelling within 53 degrees of the zenith, steerable antenna 502 may compute and/or determine the angular displacement of two plates as elevation angle=37°→$\theta_r$=−47° and azimuth angle=180→$\phi$=−113°.

In one example, antenna coordinate system 504 may include and/or represent a body coordinate frame denoted in FIG. 5 with the subscript "B" and a pointing coordinate frame denoted in FIG. 5 with the subscript "P". In this example, the body coordinate frame may be right-handed with the z-axis pointing downward, and the pointing coordinate frame may be right-handed with the z-axis pointing upward. Additionally or alternatively, boresight 506 may be defined and/or aimed by (1) an elevation angle positioned between the beam-pointing vector and the $x_P y_P$ plane and (2) an azimuth angle measured from the $x_P$ axis.

Figure 10:
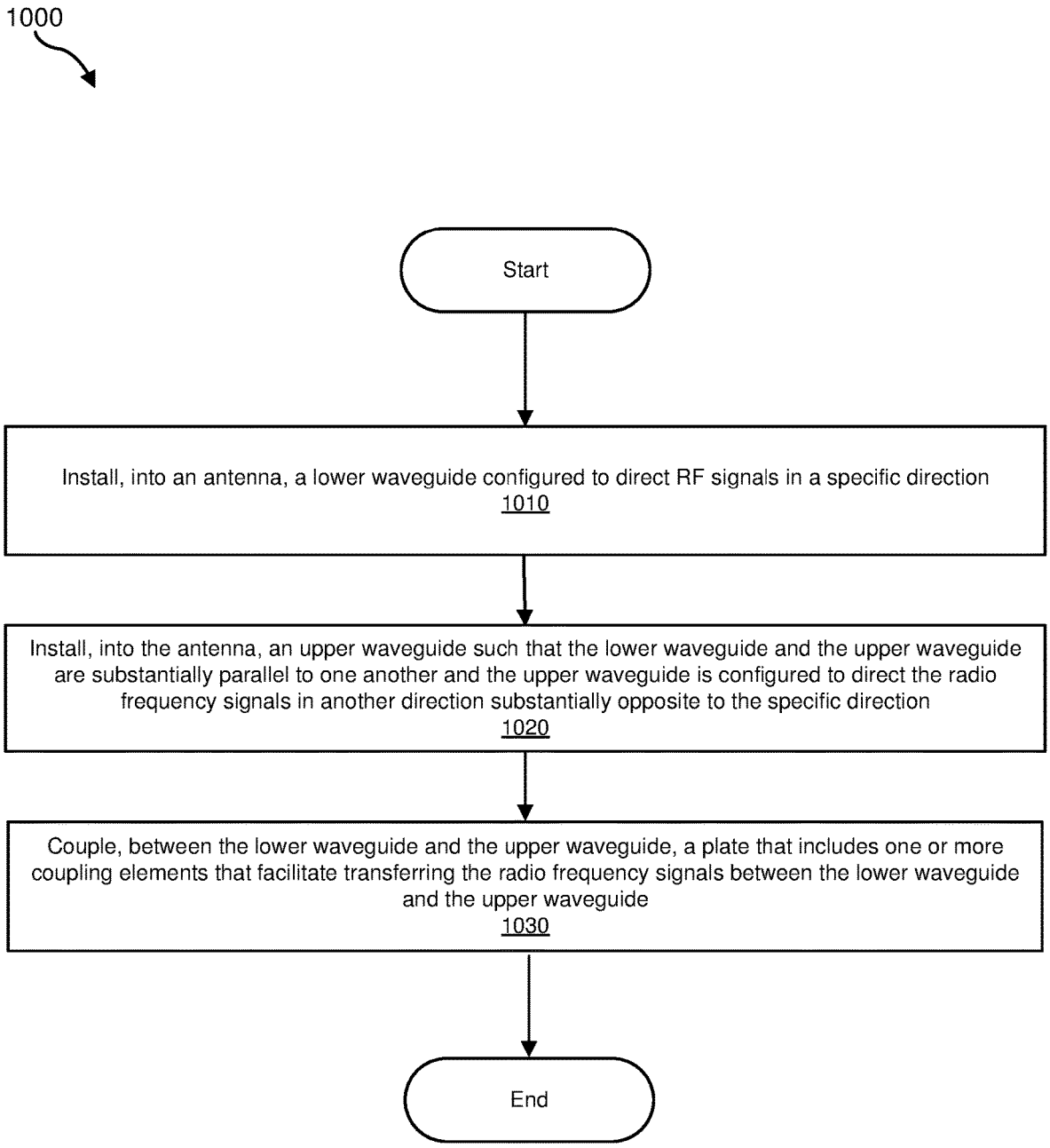
FIG. 10 is a flow diagram of an exemplary method of assembling an apparatus for transferring RF signals between parallel waveguides in antennas according to one or more embodiments of this disclosure.

FIG. 10 is a flow diagram of an exemplary method 1000 for facilitating the transfer of RF signals between waveguides and patch structures in antennas. Method 1000 may include the step of installing, into an antenna, a lower waveguide configured to direct RF signals in a specific direction (1010). Step 1010 may be performed in a variety of ways, including any of those described above in connection with FIGS. 1-9. For example, a communications equipment vendor or subcontractor may install a lower waveguide into an antenna to direct RF signals in a specific direction within the antenna. Additionally or alternatively, an antenna fabrication system may install a lower waveguide into an antenna to direct RF signals in a specific direction within the antenna.

Method 1000 may also include the step of installing, into the antenna, an upper waveguide such that the lower waveguide and the upper waveguide are substantially parallel to one another and the upper waveguide is configured to direct the RF signals in another direction substantially opposite to the specific direction (1020). Step 1020 may be performed in a variety of ways, including any of those described above in connection with FIGS. 1-9. For example, the communications equipment vendor or subcontractor may install an upper waveguide into the antenna such that the lower waveguide and the upper waveguide are substantially parallel to one another and the upper waveguide is configured to direct the RF signals in another direction substantially opposite to the specific direction. Additionally or alternatively, an antenna fabrication system may install an upper waveguide into the antenna such that the lower waveguide and the upper waveguide are substantially parallel to one another and the upper waveguide is configured to direct the RF signals in another direction substantially opposite to the specific direction.

Method 1000 may further include the step of coupling, between the lower waveguide and the upper waveguide, a plate that includes one or more coupling elements that facilitate transferring the RF signals between the lower waveguide and the upper waveguide (1030). Step 1030 may be performed in a variety of ways, including any of those described above in connection with FIGS. 1-9. For example, the communications equipment vendor or subcontractor may couple, between the lower waveguide and the upper waveguide, a plate that includes one or more coupling elements that facilitate transferring the RF signals between the lower waveguide and the upper waveguide. Additionally or alternatively, the antenna fabrication system may couple, between the lower waveguide and the upper waveguide, a plate that includes one or more coupling elements that facilitate transferring the RF signals between the lower waveguide and the upper waveguide.

EXAMPLE EMBODIMENTS

Example 1: An antenna comprising (1) a lower waveguide configured to direct radio frequency signals in a specific direction, (2) an upper waveguide positioned substantially parallel to the lower waveguide, wherein the upper waveguide is configured to direct the radio frequency signals in another direction substantially opposite to the specific direction, and (3) a plate coupled between the lower waveguide and the upper waveguide, wherein the plate includes one or more coupling elements that facilitate transferring the radio frequency signals between the lower waveguide to the upper waveguide.

Example 2: The antenna of Example 1, wherein at least one of the coupling elements comprises (1) a lower patch that is coupled to a dielectric and facing the lower waveguide and (2) an upper patch that is coupled to the dielectric and facing the upper waveguide.

Example 3: The antenna of either of Examples 1 and 2, wherein each coupling element is positioned between a lower slot formed in the lower waveguide and an upper slot formed in the upper waveguide such that the lower patch is exposed to the lower waveguide via the lower slot and the upper patch is exposed to the upper waveguide via the upper slot.

Example 4: The antenna of any of Examples 1-3, wherein the dielectric (1) is incorporated in the plate, (2) is exposed around the lower patch facing the lower waveguide, and (3) is exposed around the upper patch facing the upper waveguide.

Example 5: The antenna of any of Examples 1-4, wherein the at least one of the coupling elements comprises a plurality of conductive vias disposed through the dielectric around the lower patch and the upper patch.

Example 6: The antenna of any of Examples 1-5, wherein the coupling elements comprise a slot that interfaces the lower waveguide and the upper waveguide.

Example 7: The antenna of any of Examples 1-6, wherein the coupling elements are positioned at a specific distance from an end of the lower waveguide and an end of the upper waveguide, wherein the specific distance is a quarter wavelength of the radio frequency signal.

Example 8: The antenna of any of Examples 1-7, further comprising a plurality of conductive vias incorporated in the circuit board, wherein the plurality of conductive vias electrically couple the first metal section formed in the first layer and the second metal section formed in the second layer.

Example 9: The antenna of any of Examples 1-8, further comprising at least one of (1) a reflector applied to an end of the lower waveguide positioned proximate to the coupling elements or (2) a reflector applied to an end of the upper waveguide positioned proximate to the coupling elements.

Example 10: The antenna of any of Examples 1-9, wherein the plate comprises at least one of (1) a metal plate or (2) a dielectric substrate with metallic outer layers.

Example 11: A system comprising (1) a satellite and (2) a steerable antenna wirelessly coupled to the satellite, wherein the steerable antenna comprises (A) a lower waveguide configured to direct radio frequency signals in a specific direction, (B) an upper waveguide positioned substantially parallel to the lower waveguide, wherein the upper waveguide is configured to direct the radio frequency signals in another direction substantially opposite to the specific direction, and (C) a plate coupled between the lower waveguide and the upper waveguide, wherein the plate includes one or more coupling elements that facilitate transferring the radio frequency signals between the lower waveguide to the upper waveguide.

Example 12: The system of Example 11, wherein at least one of the coupling elements comprises (1) a lower patch that is coupled to a dielectric and facing the lower waveguide and (2) an upper patch that is coupled to the dielectric and facing the upper waveguide.

Example 13: The system of either of Examples 11 and 12, wherein each coupling element is positioned between a lower slot formed in the lower waveguide and an upper slot formed in the upper waveguide such that the lower patch is exposed to the lower waveguide via the lower slot and the upper patch is exposed to the upper waveguide via the upper slot.

Example 14: The system of any of Examples 11-13, wherein the dielectric (1) is incorporated in the plate, (2) is exposed around the lower patch facing the lower waveguide, and (3) is exposed around the upper patch facing the upper waveguide.

Example 15: The system of any of Examples 11-14, wherein the at least one of the coupling elements comprises a plurality of conductive vias disposed through the dielectric around the lower patch and the upper patch.

Example 16: The system of any of Examples 11-15, wherein the coupling elements comprise a slot that interfaces the lower waveguide and the upper waveguide.

Example 17: The system of any of Examples 11-16, wherein the coupling elements are positioned at a specific distance from an end of the lower waveguide and an end of the upper waveguide, wherein the specific distance is a quarter wavelength of the radio frequency signal.

Example 18: The system of any of Examples 11-17, further comprising at least one of (1) a reflector applied to an end of the lower waveguide positioned proximate to the coupling elements or (2) a reflector applied to an end of the upper waveguide positioned proximate to the coupling elements.

Example 19: The system of any of Examples 11-18, further comprising a radio frequency component coupled to the lower waveguide, wherein the radio frequency component is configured to perform at least one of (1) launching the radio frequency signal into the lower waveguide such that the radio frequency signal traverses from the lower waveguide to the upper waveguide via the coupling elements or (2) receiving the radio frequency signal from the lower waveguide after the radio frequency signal has traversed from the upper waveguide to the lower waveguide via the coupling elements.

Example 20: A method may comprise (1) installing, into an antenna, a lower waveguide configured to direct radio frequency signals in a specific direction, (2) installing, into the antenna, an upper waveguide such that (A) the lower waveguide and the upper waveguide are substantially parallel to one another and (B) the upper waveguide is configured to direct the radio frequency signals in another direction substantially opposite to the specific direction, and (3) coupling, between the lower waveguide and the upper waveguide, a plate that includes one or more coupling elements that facilitate transferring the radio frequency signals between the lower waveguide and the upper waveguide.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to any claims appended hereto and their equivalents in determining the scope of the present disclosure.

Unless otherwise noted, the terms "connected to" and "coupled to" (and their derivatives), as used in the specification and/or claims, are to be construed as permitting both direct and indirect (i.e., via other elements or components) connection. In addition, the terms "a" or "an," as used in the specification and/or claims, are to be construed as meaning "at least one of." Finally, for ease of use, the terms "including" and "having" (and their derivatives), as used in the specification and/or claims, are interchangeable with and have the same meaning as the word "comprising."

What is claimed is:

1. An antenna comprising:

a lower waveguide configured to direct radio frequency signals in a specific direction;

an upper waveguide positioned substantially parallel to the lower waveguide, wherein the upper waveguide is configured to direct the radio frequency signals in another direction substantially opposite to the specific direction; and a plate coupled between the lower waveguide and the upper waveguide, wherein the plate includes one or more coupling elements that facilitate transferring the radio frequency signals between the lower waveguide to the upper waveguide.

2. The antenna of claim 1, wherein at least one of the coupling elements comprises:

a lower patch that is coupled to a dielectric and facing the lower waveguide; and an upper patch that is coupled to the dielectric and facing the upper waveguide.

3. The antenna of claim 2, wherein each coupling element is positioned between a lower slot formed in the lower waveguide and an upper slot formed in the upper waveguide such that the lower patch is exposed to the lower waveguide via the lower slot and the upper patch is exposed to the upper waveguide via the upper slot.

4. The antenna of claim 2, wherein the dielectric:

is incorporated in the plate;

is exposed around the lower patch facing the lower waveguide; and is exposed around the upper patch facing the upper waveguide.

5. The antenna of claim 2, wherein the at least one of the coupling elements comprises a plurality of conductive vias disposed through the dielectric around the lower patch and the upper patch.

6. The antenna of claim 1, wherein the coupling elements comprise a slot that interfaces the lower waveguide and the upper waveguide.

7. The antenna of claim 1, wherein the coupling elements are positioned at a specific distance from an end of the lower waveguide and an end of the upper waveguide, wherein the specific distance is a quarter wavelength of the radio frequency signals.

8. The antenna of claim 1, further comprising at least one of:

a reflector applied to an end of the lower waveguide positioned proximate to the coupling elements; or a reflector applied to an end of the upper waveguide positioned proximate to the coupling elements.

9. The antenna of claim 1, further comprising a radio frequency component coupled to the lower waveguide, wherein the radio frequency component is configured to perform at least one of:

launching the radio frequency signals into the lower waveguide such that the radio frequency signals traverse from the lower waveguide to the upper waveguide via the coupling elements; or receiving the radio frequency signals from the lower waveguide after the radio frequency signals have traversed from the upper waveguide to the lower waveguide via the coupling elements.

10. The antenna of claim 1, wherein the plate comprises at least one of:

a metal plate; or a dielectric substrate with metallic outer layers.

11. A system comprising:

a satellite; and a steerable antenna wirelessly coupled to the satellite, wherein the steerable antenna comprises:

a lower waveguide configured to direct radio frequency signals in a specific direction;

an upper waveguide positioned substantially parallel to the lower waveguide, wherein the upper waveguide is configured to direct the radio frequency signals in another direction substantially opposite to the specific direction; and a plate coupled between the lower waveguide and the upper waveguide, wherein the plate includes one or more coupling elements that facilitate transferring the radio frequency signals between the lower waveguide to the upper waveguide.

12. The system of claim 11, wherein at least one of the coupling elements comprises:

a lower patch that is coupled to a dielectric and facing the lower waveguide; and an upper patch that is coupled to the dielectric and facing the upper waveguide.

13. The system of claim 12, wherein each coupling element is positioned between a lower slot formed in the lower waveguide and an upper slot formed in the upper waveguide such that the lower patch is exposed to the lower waveguide via the lower slot and the upper patch is exposed to the upper waveguide via the upper slot.

14. The system of claim 12, wherein the dielectric:

is incorporated in the plate;

is exposed around the lower patch facing the lower waveguide; and is exposed around the upper patch facing the upper waveguide.

15. The system of claim 12, wherein the at least one of the coupling elements comprises a plurality of conductive vias disposed through the dielectric around the lower patch and the upper patch.

16. The system of claim 11, wherein the coupling elements comprise a slot that interfaces the lower waveguide and the upper waveguide.

17. The system of claim 11, wherein the coupling elements are positioned at a specific distance from an end of the lower waveguide and an end of the upper waveguide, wherein the specific distance is a quarter wavelength of the radio frequency signals.

18. The system of claim 17, further comprising at least one of:

a reflector applied to an end of the lower waveguide positioned proximate to the coupling elements; or a reflector applied to an end of the upper waveguide positioned proximate to the coupling elements.

19. The system of claim 11, further comprising a radio frequency component coupled to the lower waveguide, wherein the radio frequency component is configured to perform at least one of:

launching the radio frequency signals into the lower waveguide such that the radio frequency signals traverse from the lower waveguide to the upper waveguide via the coupling elements; or receiving the radio frequency signals from the lower waveguide after the radio frequency signals have traversed from the upper waveguide to the lower waveguide via the coupling elements.

20. A method comprising:

installing, into an antenna, a lower waveguide configured to direct radio frequency signals in a specific direction;

installing, into the antenna, an upper waveguide such that:

the lower waveguide and the upper waveguide are substantially parallel to one another; and the upper waveguide is configured to direct the radio frequency signals in another direction substantially opposite to the specific direction; and coupling, between the lower waveguide and the upper waveguide, a plate that includes one or more coupling elements that facilitate transferring the radio frequency signals between the lower waveguide and the upper waveguide.

* * * * *